US006660218B2

(12) United States Patent
Davis et al.

(10) Patent No.: US 6,660,218 B2
(45) Date of Patent: Dec. 9, 2003

(54) FILAMENT DRAW JET APPARATUS AND PROCESS

(75) Inventors: Michael C. Davis, Midlothian, VA (US); Edgar N. Rudisill, Nashville, TN (US); Michael John Moore, Sr., Colonial Heights, VA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 305 days.

(21) Appl. No.: 09/682,171

(22) Filed: Jul. 31, 2001

(65) Prior Publication Data

US 2003/0030191 A1 Feb. 13, 2003

(51) Int. Cl.[7] ..... B65H 51/16; D01D 5/098; D01D 5/14; D02J 1/22; D04H 3/16

(52) U.S. Cl. ..... 264/555; 19/66 R; 19/242; 28/271; 226/7; 226/97.4; 264/103; 264/210.8; 264/211.14; 425/66; 425/72.2; 425/326.1; 425/377; 425/382.2

(58) Field of Search ..... 264/103, 210.8, 264/211.14, 555; 425/66, 72.2, 326.1, 377, 382.2; 19/66 R, 242; 28/271; 226/7, 97.4

(56) References Cited

U.S. PATENT DOCUMENTS

| | | | | |
|---|---|---|---|---|
| 3,094,262 | A | | 6/1963 | Ashby et al. |
| 3,156,395 | A | | 11/1964 | Ashby et al. |
| 3,302,237 | A | | 2/1967 | Cope et al. |
| 3,338,992 | A | | 8/1967 | Kinney |
| 3,576,284 | A | | 4/1971 | Fellous et al. |
| 3,766,606 | A | | 10/1973 | Piper et al. |
| 3,802,817 | A | | 4/1974 | Matsuki et al. |
| 3,806,017 | A | | 4/1974 | Brethauer |
| 3,806,289 | A | | 4/1974 | Schwarz |
| 3,945,815 | A | | 3/1976 | Schmidt |
| 4,064,605 | A | | 12/1977 | Akiyama et al. |
| 4,322,027 | A | * | 3/1982 | Reba ..... 226/97.4 |
| 5,068,141 | A | | 11/1991 | Kubo et al. |
| 5,292,239 | A | | 3/1994 | Zeldin et al. |
| 6,183,684 | B1 | | 2/2001 | Lu |

FOREIGN PATENT DOCUMENTS

| | | |
|---|---|---|
| EP | 1 072 697 A1 | 1/2001 |
| GB | 2121423 A | 12/1983 |
| WO | WO 93/24693 A1 | 12/1993 |
| WO | WO 01/46507 A1 | 6/2001 |

* cited by examiner

*Primary Examiner*—Leo B. Tentoni

(57) ABSTRACT

The present invention is directed to a draw jet for drawing thermoplastic polymer filaments including a drawing slot defined by an entrance member including a converging passageway communicating with a continuing passageway, terminating at an outlet portion, a drawing member including an inlet portion having a drawing gap width of about 2.0 to about 10 mm communicating with the outlet portion of the entrance member, and at least one air nozzle for directing high speed air onto the filaments in a downstream direction positioned between the outlet portion of the entrance member and the inlet portion of the drawing member, and with a nozzle gap width wherein the gap ratio of the drawing gap width to the combined width of all of the nozzle gaps is from about 1.0 to about 10.

16 Claims, 1 Drawing Sheet

FILAMENT DRAW JET APPARATUS AND PROCESS

BACKGROUND OF THE INVENTION

This invention relates to using a synthetic polymer melt spinning process with a high speed draw jet to make drawn filaments. More specifically, the high speed draw jet utilizes the tension created by high velocity air when it impinges a filament threadline to draw the filaments. The filaments can be collected on a screen and bonded together to make a nonwoven fabric or wound up for use in a woven fabric or other end-uses.

Jet devices have been used with synthetic polymer textile filaments for many purposes including drawing, texturing, bulking, crimping, interlacing, etc. For example, spunbond nonwoven fabrics are typically made by melt spinning one or more rows of filaments, drawing the filaments, collecting the random laydown of filaments on a screen, and bonding the filaments together. A method of drawing the filaments is subjecting the row or rows of filaments to a draw jet. The draw jet uses downwardly projected high velocity air to provide tension on the filaments which draws them. As the tension increases, the polymer throughput and filament speed increases. This would lead to increased productivity. However, consuming more air can be expensive. Also, the air may be heated which adds to the expense. In the spunbond process, too much air flow can lead to non-uniformity in the laydown process. Therefore, it would be advantageous to minimize air usage while increasing filament tension. It would be desirable to use a draw jet that can provide high tension to a filament threadline for drawing, while using minimal air at high velocity to increase productivity.

SUMMARY OF THE INVENTION

In a first embodiment, the present invention is directed to a draw jet for drawing thermoplastic polymer filaments comprising a drawing slot defined by an entrance member comprising a converging passageway communicating with a continuing passageway, terminating at an outlet portion, a drawing member comprising an inlet portion having a drawing gap width of about 2.0 to about 10 mm communicating with said outlet portion of said entrance member, and at least one air nozzle for directing high speed air onto said filaments in a downstream direction positioned between said outlet portion of said entrance member and said inlet portion of said drawing member, and with a nozzle gap width wherein the gap ratio of said drawing gap width to the combined width of all of said nozzle gaps is from about 1.0 to about 10.

Another embodiment of the present invention is directed to an apparatus for melt spinning thermoplastic polymer filaments comprising a draw jet for drawing thermoplastic polymer filaments comprising a drawing slot defined by an entrance member comprising a converging passageway communicating with a continuing passageway, terminating at an outlet portion, a drawing member comprising an inlet portion having a drawing gap width of about 2.0 to about 10 mm communicating with said outlet portion of said entrance member, and at least one air nozzle for directing high speed air onto said filaments in a downstream direction positioned between said outlet portion of said entrance member and said inlet portion of said drawing member, and with a nozzle gap width wherein the gap ratio of said drawing gap width to the combined width of all of said nozzle gaps is from about 1.0 to about 10.

In another embodiment, the present invention is directed to a process for drawing thermoplastic polymer filaments comprising drawing said filaments by a draw jet having an entrance member comprising a converging passageway communicating with a continuing passageway, terminating at an outlet portion, a drawing member comprising an inlet portion having a drawing gap width of about 2.0 to about 10 mm communicating with said outlet portion of said entrance member, and at least one air nozzle for directing high speed air onto said filaments in a downstream direction positioned between said outlet portion of said entrance member and said inlet portion of said drawing member, and with a nozzle gap width wherein the gap ratio of said drawing gap width to the combined width of all of said nozzle gaps is from about 1.0 to about 10.

In another embodiment, the present invention is directed to a process for melt spinning thermoplastic polymer filaments comprising melting a thermoplastic polymer, spinning said molten thermoplastic polymer through a spinneret and forming filaments and drawing said filaments by a draw jet having an entrance member comprising a converging passageway communicating with a continuing passageway, terminating at an outlet portion, a drawing member comprising an inlet portion having a drawing gap width of about 2.0 to about 10 mm communicating with said outlet portion of said entrance member, and at least one air nozzle for directing high speed air onto said filaments in a downstream direction positioned between said outlet portion of said entrance member and said inlet portion of said drawing member, and with a nozzle gap width wherein the gap ratio of said drawing gap width to the combined width of all of said nozzle gaps is from about 1.0 to about 10, and collecting said drawn filaments on a collection screen to form a nonwoven web.

DETAILED DESCRIPTION

Figure 1:
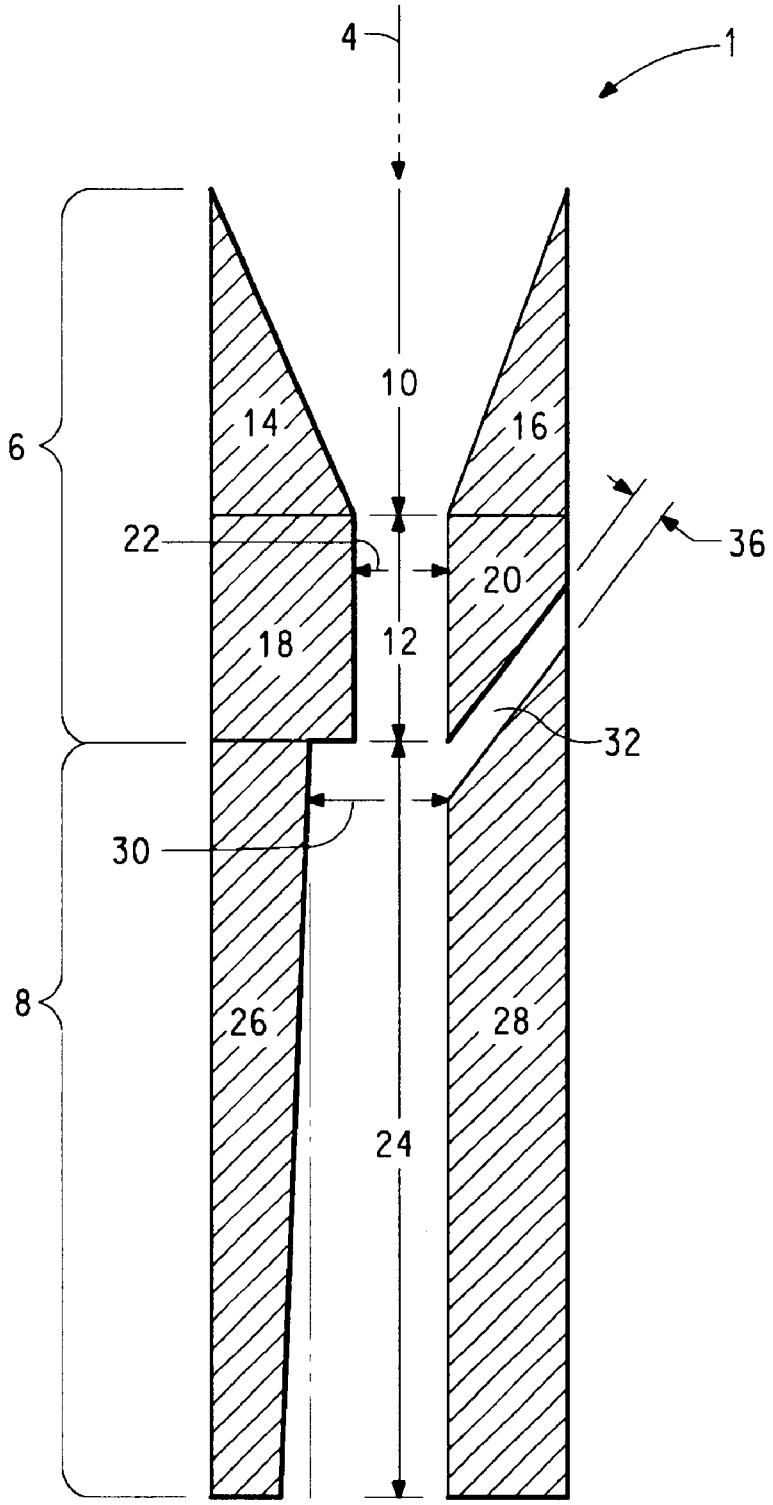
FIG. 1 is a schematic diagram of a transverse cross section of a filament draw jet of this invention.

The present invention is directed to a filament draw jet and a process for using it. This jet can be used in high speed melt spinning processes which would obviate the need for filament draw rolls. In a spunbond process, these filaments can be collected on a forming screen and bonded together to produce a nonwoven fabric or web. This fabric or web can be used, for example, in filters, wipes, and hygiene products.

According to the invention, a curtain of melt spun filaments are guided through a draw jet wherein the filaments are impacted with high speed air creating tension on the threadline. This tension causes the filaments to be drawn resulting in a smaller filament diameter and increased molecular alignment (increased crystallinity) for increased filament strength.

This invention can be described with reference to a specific example of drawing filaments with a draw jet according to the apparatus of FIG. 1.

FIG. 1 is a schematic diagram of a transverse cross section of a filament draw jet of this invention. A thermoplastic synthetic polymer is melted in an extruder and spun through a spinning beam to produce filaments (not shown). Draw jet 1 is located below the spinning beam. Draw jet 1 has a slot shaped opening running along the length of the spinning beam. FIG. 1 shows the cross section of draw jet 1 looking down the slot.

The filaments are guided into and through slot 4 of draw jet 1. Slot 4 is formed from entrance member 6 attached to drawing member 8. Entrance member 6 comprises converging passageway 10 and continuing passageway 12. Converging passageway 10 is defined by converging plates 14 and 16, and continuing passageway 12 is defined by continuing plates 18 and 20, attached to converging plates 14 and 16, respectively. The length of continuing passageway 12 can be minimized so long as room is provided for air nozzle 32. The walls of continuing plates 18 and 20 can be in a parallel arrangement as is shown in FIG. 1. Entrance member 6 terminates with an outlet portion at the end of continuing passageway 12. Continuing passageway 12 defines entrance gap width 22. Entrance gap width 22 is from about 0.5 to about 4.0 mm.

Drawing member 8 comprises drawing passageway 24, defined by drawing plates 26 and 28. The inlet portion of drawing member 8 communicates in axial alignment with the outlet portion of entrance member 6. End plates (not shown) enclose each end of the draw jet, covering the ends of converging plates 14 and 16, continuing plates 18 and 20, and drawing plates 26 and 28. Drawing passageway 24 is defined by drawing plates 26 and 28, and at its narrowest part defines drawing gap width 30. Drawing gap width 30 is preferably from about 2.0 to about 10 mm, more preferably from about 2.3 to about 8 mm, and most preferably from about 2.6 to about 6 mm. Drawing gap width 30 is equal to or larger than entrance gap width 22. The drawing member length is preferably from about 25 to about 75 cm, more preferably from about 28 to about 65 cm, and most preferably from about 30 to about 55 cm. Drawing passageway 24 defines a divergence angle with either one or both of plates 26 and 28 diverging away from the axial alignment of slot 4. The divergence angle is preferably from about 0.0 to about 5 degrees, more preferably from about 0.1 to about 3 degrees, and most preferably from about 0.2 to about 1 degree.

Air nozzle 32 is positioned between the outlet portion of entrance member 6 and the inlet portion of drawing member 8 and directs high speed air onto filaments in slot 4 in a downstream direction. Specifically, air nozzle 32 is formed between either continuing plate 18 and drawing plate 26 or between continuing plate 20 and drawing plate 28. In the case of two air nozzles opposite each other, each air nozzle would be located between a pair of continuing and drawing plates. Air nozzle 32 has a nozzle gap width 36.

A gap ratio is defined as: gap ratio=drawing gap width/(combined width of all of the nozzle gaps), wherein the combined width of all of the nozzle gaps is the sum of all of the individual nozzle gaps if there is more than one nozzle gap. The gap ratio is preferably from about 1.0 to about 10, more preferably from about 1.2 to about 7 and most preferably from about 1.4 to about 5.

The drawn filaments can be collected on a collection screen (not shown) to form a nonwoven web.

Filament spinning speeds over 6,000 m/min can be obtained.

EXAMPLE 1

A spunbond fabric was made using a bicomponent spinning pack where the fibers were made from a blend of linear low density polyethylenes with 20% being Dow ASPUN ® 6811A with a melt index of 27 g/10 minutes (measured according to ASTM D-1238) and 80% Dow ASPUN ® 61800.34 with a melt index of 17–18 g/10 minutes (measured according to ASTM D-1238), and poly(ethylene terephthalate) polyester with an intrinsic viscosity of 0.53 (as measured in U.S. Pat. No. 4,743,504) available from DuPont as Crystar ® polyester (Merge 3949). The polyester resin was crystallized at a temperature of 180° C. and dried at a temperature of 120° C. to a moisture content of less than 50 ppm before use.

The polyester was heated to 290° C. and the polyethylene was heated to 280° C. in separate extruders. The polymers were extruded, filtered and metered to a bicomponent spin pack maintained at 295° C. and designed to provide a sheath-core filament cross section. The polymers were spun through the spinneret to produce bicomponent filaments with a polyethylene sheath and a poly(ethylene terephthalate) core. The total polymer throughput per spin pack capillary was 0.8 g/min. The polymers were metered to provide filament fibers that were 30% polyethylene (sheath) and 70% polyester (core), based on fiber weight. The filaments were cooled in a 38 cm long quenching zone with quenching air provided from two opposing quench boxes a temperature of 12° C. and velocity of 1 The filaments were then passed into the pneumatic draw jet of this invention, spaced 63 cm below the capillary openings of the spin pack. The length of the drawing member of the jet was 30 cm, the entrance gap width was 2.79 mm, the nozzle gap width was 1.02 mm, the drawing gap width was 3.56 mm, the gap ratio of the drawing gap width to the nozzle gap width was 3.5, and the drawing passageway of the drawing member had a divergence angle of 0.3 degrees. Samples were collected while the draw jet supply air pressure was varied from 210 to 420 kPa. At these conditions the jet produced a drawing tension such that the filaments were drawn up to a maximum rate of approximately 10,000 m/min. Any observed filaments that would break were quickly and automatically pulled back into the draw jet due to the suction at the entrance section. The resulting small, strong substantially continuous filaments were deposited onto a laydown belt with vacuum suction. The fibers in the web had an effective size in the range of about 0.70 to 1.0 dpf. See Table 1 for fiber size and speed data.

EXAMPLE 2

Samples were run per the procedure in Example 1 and with the same jet drawing apparatus except the total polymer mass throughput per hole was 1.2 g/min. See Table 1 for fiber size and speed data. TABLE 1: FIBER SIZE AND SPEED

| Jet Air Supply Pressure (kPa) | Example 1: 0.8 g/min/hole Fiber Size (dpf) | Fiber Speed (m/min) | Example 2: 1.2 g/min/hole Fiber Size (dpf) | Fiber Speed (m/min) |
|---|---|---|---|---|
| 210 | 0.91 | 7903 | 1.35 | 8014 |
| 280 | 0.81 | 8927 | 1.15 | 9425 |
| 350 | 0.75 | 9664 | 1.05 | 10322 |
| 420 | 0.73 | 9812 | 1.01 | 10690 |

EXAMPLE 3

Meltspun fibers were made using a bicomponent spinning pack where the fibers where both sides were fed with a poly(ethylene terephthalate) polyester with an intrinsic viscosity of 0.53 (as measured in U.S. Pat. No. 4,743,504) available from DuPont as Crystar ® polyester (Merge 3949). The polyester resin was crystallized and dried in a vacuum oven at a temperature of 160° C. to a moisture content of less than 50 before use.

The polyester was melted and heated to 287° C. in two separate extruders. The polymer were extruded, filtered and metered to a bicomponent spin pack maintained at 292° C. The polymer was spun through the spinneret to produce single component filaments. The total polymer throughput per spin pack capillary was 0.4 g/min. The filaments were cooled in a 38 cm long quenching zone with quenching air provided from a two sided co-current passive quench box at a ambient air temperature of 25° C. The filaments then passed into the pneumatic draw jet of this invention, spaced 67 cm below the capillary openings of the spin pack. The length of the drawing member of the jet was 30 cm, the entrance gap width was 1.27 mm, the nozzle gap width was 1.02 mm, the drawing gap width was 2.03 mm, the gap ratio of the drawing gap width to the nozzle gap width was 2.0, and drawing passageway of the drawing member had a divergence angle of 0.3 degrees. Samples were collected with the draw jet supply air pressure at 140 and 170 kPa. At these conditions the jet produced a drawing tension such that the filaments were drawn up to a maximum rate of approximately 6,000 m/min. Any observed filaments that would break were quickly and automatically pulled back into the draw jet due to the suction at the entrance section. The resulting small, strong substantially continuous filaments were collected and analyzed. The fibers had an effective diameter in the range of 0.6 dpf. See Table 2 for fiber size and speed data. TABLE 2: FIBERSIZE AND SPEED

| Jet Air Supply Pressure (kPa) | Fiber Size (dpf) | Fiber Speed (m/min) |
|---|---|---|
| 140 | 0.63 | 5714 |
| 170 | 0.58 | 6143 |

What is claimed is:

1. A draw jet for drawing thermoplastic polymer filaments comprising a drawing slot defined by an entrance member comprising a converging passageway communicating with a continuing passageway, terminating at an outlet portion;

a drawing member comprising an inlet portion having a drawing gap width of about 2.0 to about 10 mm communicating with said outlet portion of said entrance member; and at least one air nozzle for directing high speed air onto said filaments in a downstream direction positioned between said outlet portion of said entrance member and said inlet portion of said drawing member, and with a nozzle gap width wherein the gap ratio of said drawing gap width to the combined width of all of said nozzle gaps is from about 1.0 to about 10.

2. The draw jet of claim 1, wherein there is only one air nozzle.

3. An apparatus for melt spinning thermoplastic polymer filaments comprising a draw jet comprising a drawing slot defined by an entrance member comprising a converging passageway communicating with a continuing passageway, terminating at an outlet portion;

a drawing member comprising an inlet portion having a drawing gap width of about 2.0 to about 10 mm communicating with said outlet portion of said entrance member; and at least one air nozzle for directing high speed air onto said filaments in a downstream direction positioned between said outlet portion of said entrance member and said inlet portion of said drawing member, and with a nozzle gap width wherein the gap ratio of said drawing gap width to the combined width of all of said nozzle gaps is from about 1.0 to about 10.

4. The apparatus of claim 3, wherein there is only one air nozzle.

5. The apparatus of claim 3, wherein disposed upstream of said draw jet is a melt spinning apparatus for melting a thermoplastic polymer, spinning said molten thermoplastic polymer, and forming filaments; and disposed downstream of said draw jet is a filament collection screen for collecting drawn filaments into a nonwoven web.

6. The apparatus of claim 5, wherein there is only one air nozzle.

7. The apparatus of any of claims 1 to 6, wherein said drawing gap width is about 2.3 to about 8 mm and said gap ratio of said drawing gap width to the combined width of all of said nozzle gaps is from about 1.2 to about 7.

8. The apparatus of any of claims 1 to 6, wherein said drawing gap width is about 2.6 to about 6 mm and said gap ratio of said drawing gap width to the combined width of all of said nozzle gaps is from about 1.4 to about 5.

9. The apparatus of claims 1 or 3, wherein said drawing member has a drawing passageway with a divergence angle between gap walls of about 0.0 to about 5 degrees.

10. A process for drawing thermoplastic polymer filaments comprising drawing said filaments by a draw jet having an entrance member comprising a converging passageway communicating with a continuing passageway, terminating at an outlet portion;

a drawing member comprising an inlet portion having a drawing gap width of about 2.0 to about 10 mm communicating with said outlet portion of said entrance member; and at least one air nozzle for directing high speed air onto said filaments in a downstream direction positioned between said outlet portion of said entrance member and said inlet portion of said drawing member, and with a nozzle gap width wherein the gap ratio of said drawing gap width to the combined width of all of said nozzle gaps is from about 1.0 to about 10.

11. The process of claim 10, wherein there is only one air nozzle.

12. A process for melt spinning thermoplastic polymer filaments comprising melting a thermoplastic polymer, spinning said molten thermoplastic polymer through a spinneret and forming filaments; and drawing said filaments by a draw jet having an entrance member comprising a converging passageway communicating with a continuing passageway, terminating at an outlet portion;

a drawing member comprising an inlet portion having a drawing gap width of about 2.0 to about 10 mm communicating with said outlet portion of said entrance member; and at least one air nozzle for directing high speed air onto said filaments in a downstream direction positioned between said outlet portion of said entrance member and said inlet portion of said drawing member, and with a nozzle gap width wherein the gap ratio of said drawing gap width to the combined width of all of said nozzle gaps is from about 1.0 to about 10; and collecting said drawn filaments on a collection screen to form a nonwoven web.

13. The process of claim 12, wherein there is only one air nozzle.

14. The process of any of claims 10 to 13, wherein said drawing gap width is about 2.3 to about 8 mm and said gap ratio of said drawing gap width to the combined width of all of said nozzle gaps is from about 1.2 to about 7.

15. The process of any of claims 10 to 13, wherein said drawing gap width is about 2.6 to about 6 mm and said gap ratio of said drawing gap width to the combined width of all of said nozzle gaps is from about 1.4 to about 5.

16. The process of claims 10 or 12, wherein said drawing member has a drawing passageway with a divergence angle between gap walls of about 0.0 to about 5 degrees.

* * * * *